US006568920B2

(12) United States Patent
Yttri et al.

(10) Patent No.: US 6,568,920 B2
(45) Date of Patent: May 27, 2003

(54) MANIFOLD ASSEMBLY FOR A COMPRESSOR

(75) Inventors: Christopher O. Yttri, Mesa, AZ (US); Joseph P. Lackie, Amherst, NY (US); Michael F. Wieland, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 59 days.

(21) Appl. No.: 09/934,193

(22) Filed: Aug. 21, 2001

(65) Prior Publication Data

US 2003/0039559 A1 Feb. 27, 2003

(51) Int. Cl.[7] ..... F04B 39/00; F04B 53/00
(52) U.S. Cl. ..... 417/312; 418/81
(58) Field of Search ..... 417/410.4, 410.5, 417/296, 312; 123/184.42; 418/181

(56) References Cited

U.S. PATENT DOCUMENTS

| | | | | |
|---|---|---|---|---|
| 4,033,707 A | * | 7/1977 | Stutzman | 417/312 |
| 4,813,852 A | | 3/1989 | Ikeda et al. | 417/269 |
| 4,930,995 A | | 6/1990 | Suzuki et al. | 417/312 |
| 5,147,190 A | | 9/1992 | Hovarter | 417/571 |
| 5,186,475 A | | 2/1993 | Kawai et al. | 277/181 |
| 5,401,150 A | | 3/1995 | Brown | 418/181 |
| 5,503,537 A | * | 4/1996 | Schlossarczyk et al. | 417/296 |
| 5,533,870 A | | 7/1996 | Takenaka et al. | 417/269 |
| 5,655,492 A | * | 8/1997 | Sattler et al. | 123/184.42 |
| 5,749,710 A | | 5/1998 | Kimura et al. | 417/63 |
| 6,158,983 A | * | 12/2000 | Harpole et al. | 417/410.4 |
| 6,280,155 B1 | * | 8/2001 | Dreiman | 417/410.5 |

FOREIGN PATENT DOCUMENTS

| | | | | |
|---|---|---|---|---|
| DE | 10031679 A1 | | 1/2001 | |
| KR | 2001059281 | * | 11/2001 | F04B/39/00 |

* cited by examiner

*Primary Examiner*—Teresa Walberg
*Assistant Examiner*—Leonid Fastovsky
(74) *Attorney, Agent, or Firm*—Patrick M. Griffin

(57) ABSTRACT

A manifold assembly for use in a compressor having a compression chamber for compressing a refrigerant is disclosed. The manifold assembly includes a housing coupled to an intake port and an exhaust port. The housing includes an outer wall and at least one inner wall to define a suction chamber for guiding the refrigerant from the intake port to the compression chamber and to define a discharge chamber for guiding the refrigerant from the compression chamber to the exhaust port. A baffle is connected to the housing. The baffle defines a first fluid cavity and an exit cavity that are in operative communication with each other and the compression chamber. The baffle eliminates acoustic resonance of the refrigerant in the discharge chamber. Other embodiments of the subject invention are disclosed that include a first and second piston for compressing the refrigerant and an air-conditioning system for circulating the refrigerant to remove heat from an interior of a vehicle.

30 Claims, 2 Drawing Sheets

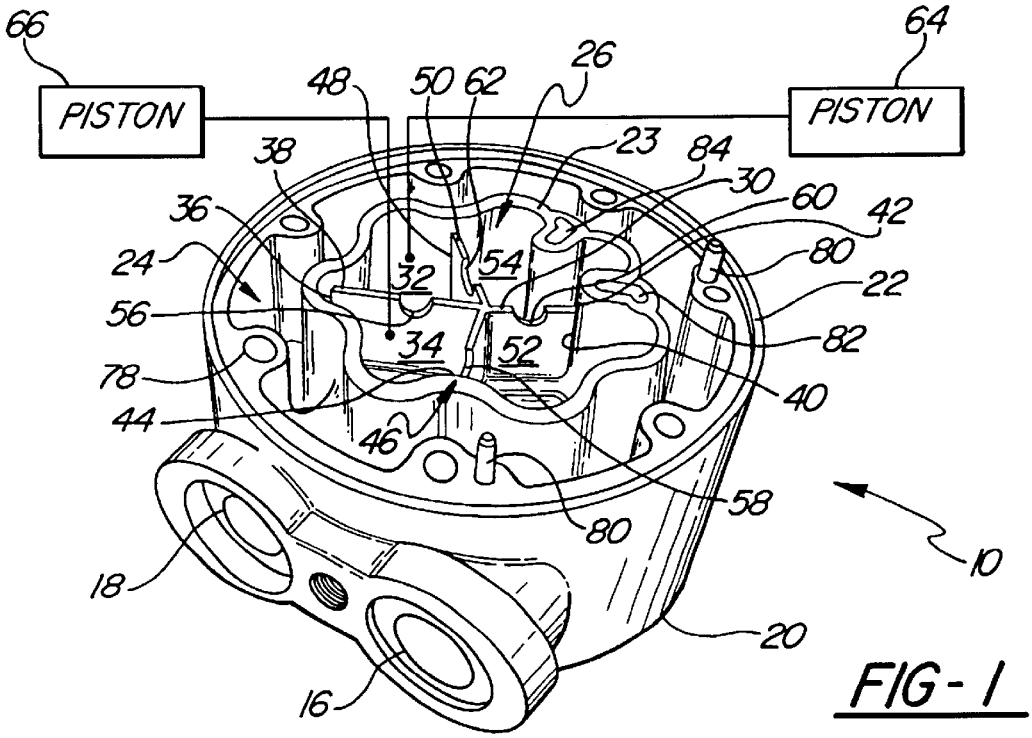
FIG-1
FIG-2
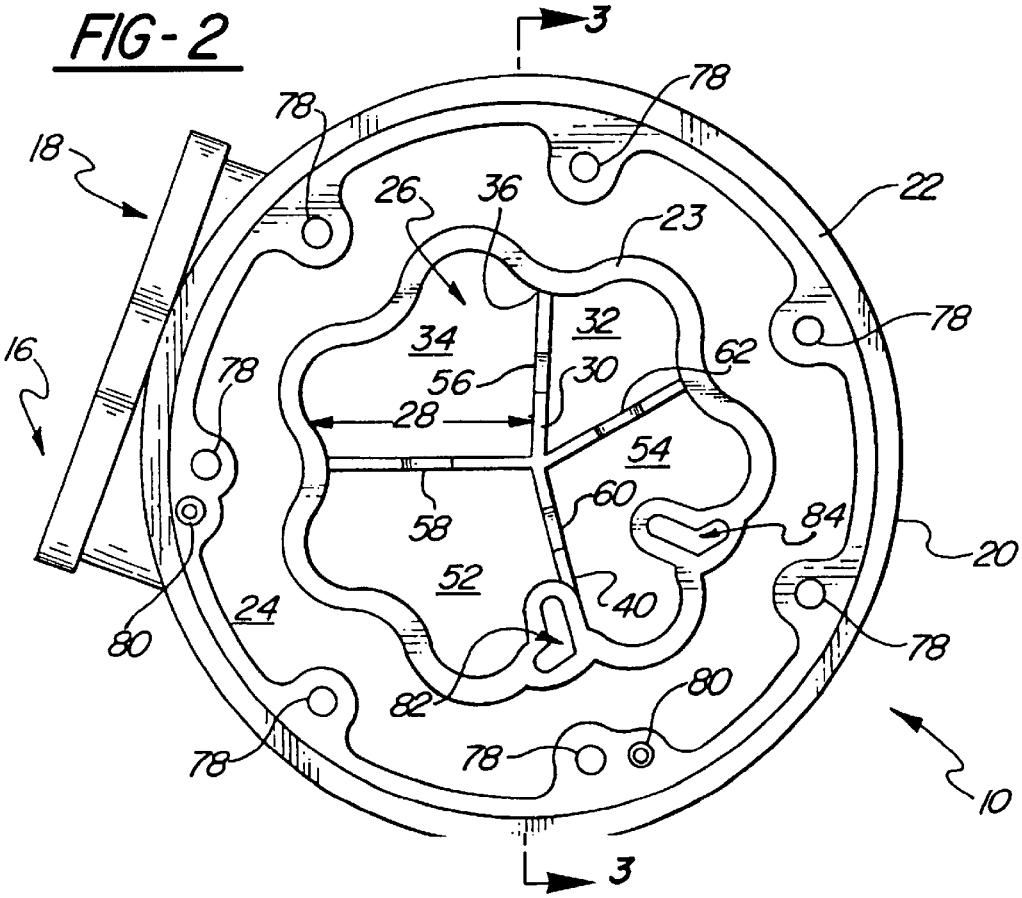

MANIFOLD ASSEMBLY FOR A COMPRESSOR

FIELD OF THE INVENTION

A manifold assembly for use in a compressor having a compression chamber for compressing a fluid is disclosed. More specifically, a manifold assembly including a baffle for eliminating acoustic resonance is disclosed.

BACKGROUND OF THE INVENTION

Vehicle air-conditioning systems include a compressor that compresses and superheats refrigerant. The refrigerant exits the compressor and continues first to a condenser and then to an expander. From the expander, the refrigerant enters an evaporator and then returns to the compressor to begin the cycle again. The air-conditioning system will include either an accumulator/dehydrator (A/D) or a receiver/dehydrator (RID). The purpose of these devices is to remove moisture from the refrigerant and to store the reserve charge of the system until it is needed upon demand.

Generally, the compressor is a belt-driven pump that includes a compression chamber and a manifold assembly comprising a housing, an intake port and an exhaust port. The housing further defines a suction chamber and a discharge chamber. The intake port guides the refrigerant from the evaporator to the suction chamber. The suction chamber subsequently guides the refrigerant from the intake port to the compression chamber where it is compressed. The compressed refrigerant is received in the discharge chamber and from the discharge chamber the refrigerant is exhausted to the exhaust port. The refrigerant is then guided from the exhaust port to the condenser to begin the cycle again.

Prior art manifolds contribute to noise problems resulting from acoustic resonance created in the discharge chamber of the manifold assembly. The acoustic resonance occurs in the refrigerant medium because the frequency, and hence the wavelength of the sound waves in the manifold assembly coincides with the discharge chamber dimensions (wavelength is a function of pressure and temperature of the refrigerant). The acoustic resonance is dependent on a volume of the discharge chamber and effective path lengths of the discharge chamber. The effective path lengths are the continuous, unobstructed paths available for sound waves to travel in the discharge chamber. Prior art manifold assemblies attempt to reduce the effective path lengths and the volume of the discharge chamber by providing a baffle that obstructs the refrigerant flow after the refrigerant has been compressed in the compression chamber.

The aforementioned baffles are shown in U.S. Pat. No. 5,401,150 to Brown. The baffles of the '150 patent to Brown impede the flow of the gas by reducing the cross-sectional area of the flow path, resulting in decoupling of the waves. The manifold assembly of the '150 patent to Brown acts to continuously reroute the air after the air has been compressed. The manifold assembly described in the '150 patent is a description of a reactive type of muffler assembly. The purpose of this assembly is to reduce the acoustic waves by cancellation. As a result, an undesirable loss in pressure from the compression chamber to the exhaust port is realized. The loss in pressure from the compression chamber to the exhaust port results in an inefficiently performing air-conditioning system. Therefore, a need exists to develop a manifold assembly having a baffle to effectively reduce the effective path lengths and as such, provide a discharge chamber that is in operative communication with both the exhaust port and the compression chamber. The resulting manifold assembly would minimize the loss in pressure from the compression chamber to the exhaust port and reduce or eliminate the acoustic resonance in the discharge chamber.

SUMMARY OF THE INVENTION

A manifold assembly for use in a compressor having a compression chamber for compressing a refrigerant is disclosed. The manifold assembly includes an intake port, an exhaust port and a housing coupled to the intake port and the exhaust port. The housing includes an outer wall and at least one inner wall. The outer wall and the inner wall define a suction chamber for guiding the refrigerant from the intake port to the compression chamber. Furthermore, the outer wall and the inner wall define a discharge chamber for guiding the refrigerant from the compression chamber to the exhaust port. A baffle is also connected to the housing. The baffle defines a first fluid cavity for receiving the refrigerant from the compression chamber and an exit cavity for guiding the refrigerant from the discharge chamber to the exhaust port. The first fluid cavity and the exit cavity are in operative communication with each other and the compression chamber and the exit cavity is in operative communication with the exhaust port. The baffle eliminates specific acoustic resonance of the refrigerant in the discharge chamber.

The manifold assembly for use in the compressor including the compression chamber and a first piston and a second piston within the compression chamber for compressing the refrigerant is also disclosed. The first piston compresses the refrigerant in the first fluid cavity and the second piston compresses the refrigerant in the exit cavity.

An air-conditioning system for circulating the refrigerant to remove heat from an interior of a vehicle is also disclosed. The air-conditioning system includes an evaporator for transferring the heat from the interior of the vehicle to the refrigerant and a condenser in fluid communication with the evaporator for cooling and condensing the refrigerant. The air-conditioning system also includes the compressor comprising the intake port, the exhaust port, the compression chamber and the housing as described above. The compressor is in fluid communication with the evaporator and the condenser to receive the refrigerant from the evaporator, compressing the refrigerant in the compression chamber, and pump the refrigerant to the condenser.

Accordingly, the advantage of the subject invention described above is the ability of the subject invention to effectively reduce the effective path lengths and to prevent the formation of acoustic resonances by the limiting the discharge chamber dimensions. More specifically, the subject invention provides a discharge chamber that is in operative communication with both the exhaust port and the compression chamber. The result is a minimization of the loss in pressure from the compression chamber to the exhaust port and a minimization of the acoustic resonance in the discharge chamber.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of a manifold assembly;

FIG. 2 is a plan view of the manifold assembly of FIG. 1;

DETAILED DESCRIPTION OF THE PREFERRED EMBODIMENT

Figure 3:
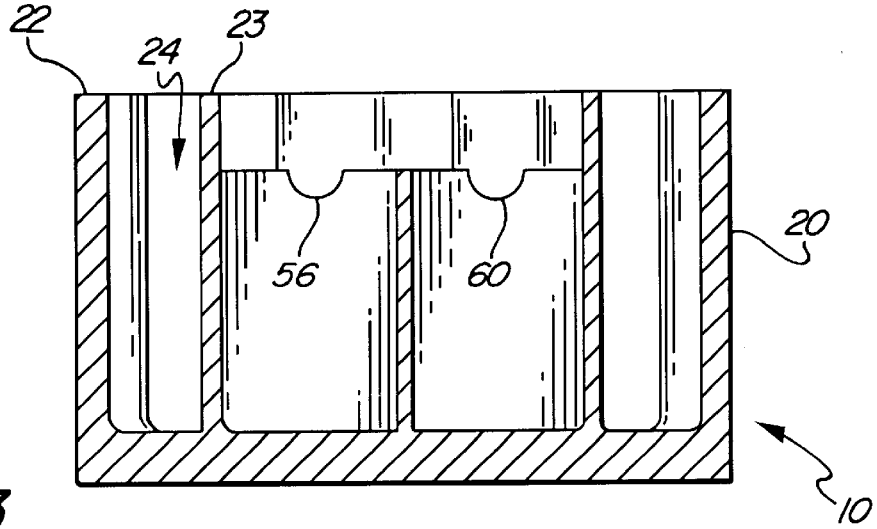
FIG. 3 is a cross-sectional view of the manifold assembly of FIG. 1 as taken along line 3—3 of FIG. 2.

Referring to the Figures, wherein like numerals indicate like or corresponding parts throughout the several views, a manifold assembly 10 for use in a compressor 12 having a compression chamber 14 for compressing a fluid is disclosed. It is to be understood that the subject invention is intended to be used in conjunction with a refrigerant, however, this is not intended to limit the subject invention. Other fluids such as, but not limited to air could also be used in conjunction with the subject invention.

Referring to FIGS. 1 and 2, the manifold assembly 10 includes an intake port 16, an exhaust port 18 and a housing 20 coupled to the intake port 16 and the exhaust port 18. The housing 20 also includes an outer wall 22 and at least one inner wall 23. The outer wall 22 and the inner wall 23 define a suction chamber 24 for guiding the refrigerant from the intake port 16 to the compression chamber 14. In the preferred embodiment, the intake port 16 is connected to the suction chamber 24 as shown in FIG. 1. The outer wall 22 and/or the inner wall 23 also define a discharge chamber 26 for guiding the refrigerant from the compression chamber 14 to the exhaust port 18. In the preferred embodiment, the suction chamber 24 substantially surrounds the discharge chamber 26, as shown in FIG. 2. This arrangement of the suction chamber 24 and the discharge chamber 26 in the preferred embodiment is advantageous for reducing acoustic resonance in the suction chamber 24. However, it should be understood that the present invention is applicable to other structural arrangements.

The primary source of the acoustic resonance is the discharge chamber 26. In general, the frequency (and corresponding wavelength) of the acoustic resonance is dependent on the volume of the discharge chamber 26, the effective path lengths 28 within the discharge chamber 26, and the fluid properties (pressure, temperature, and composition) of the refrigerant within the discharge chamber 26. These effective path lengths 28 are continuous, unobstructed path available for sound wave propagation. Acoustic resonance within the discharge chamber 26 can be reduced or eliminated if these path lengths 28 are reduced.

The housing 20 also includes a baffle 30 connected to the housing 20. The baffles 30 define a first gas or fluid cavity 32 for receiving the refrigerant gas from the compression chamber 14 and an exit cavity 34 for guiding the refrigerant from the discharge chamber 26 to the exhaust port 18. In the preferred embodiment, the baffle 30 is made from aluminum and is integrally formed with the housing 20. It is to be understood that the baffle 30 is not limited to being made from aluminum or being integrally formed with the housing 20. Baffles could be built with any number of partitions to limit or break-up, the longest effective path length in which acoustic resonances are established in the discharge cavity. Although four baffle partitioned fluid cavities are shown, this invention is not limited to any particular number of baffles or fluid cavities. The invention could include any number of partitions in any orientation to reduce the longest effect path length that establishes acoustic resonances. The baffle 30 could be a removeable insert within the housing 20 or be attached by a variety of conventional methods including, but not limited to welds, rivets, screws, and the like. Additionally, the baffle 30 in the preferred embodiment is disposed within the discharge chamber 26. The first fluid cavity 32 and the exit cavity 34 are in operative communication with each other and the compression chamber 14 to reduce the acoustic resonance of the refrigerant in the discharge chamber 26. The baffle 30 reduces the acoustic resonance by reducing the effective path lengths 28 in the discharge chamber 26. In the preferred embodiment, the exhaust port 18 is connected to the exit cavity 34 and the exit cavity 34 is continuous and unobstructed to guide the refrigerant from the compression chamber 14 to the exhaust port 18.

In the preferred embodiment, the baffle 30 includes a first end 36 connected at a first position 38 on the housing 20 and a second end 40 connected at a second position 42 on the housing 20. The baffle 30 also includes a third end 44 connected at a third position 46 on the housing 20 and a fourth end 48 connected at a fourth position 50 on the housing 20. In the preferred embodiment, the first, second, third and fourth positions 38, 42, 46, 50 are located on the inner wall 23 of the housing 20. It is to be understood that the baffle 30 does not need to be connected at each of the aforementioned positions. The baffle 30 of the subject invention could also be practiced such that the baffle 30 includes only the first end 36 and the second end 40. Furthermore, the baffle 30 may be practiced such that the first end 36 and the second end 40 are not connected to the housing 20.

The baffle 30 of the preferred embodiment defines a second fluid cavity 52 for receiving the refrigerant from the compression chamber 14 and a third fluid cavity 54 for receiving the refrigerant from the compression chamber 14. The second fluid cavity 52 is in operative communication with the third fluid cavity 54, the exit cavity 34 and the compression chamber 14. The third fluid cavity 54 is in operative communication with the first fluid cavity 32, the second fluid cavity 52 and the compression chamber 14. In the preferred embodiment, the first, second, third and exit cavities 32, 34, 52, 54 are bounded by the inner wall 23 of the housing 20 and are in operative communication with the compression chamber 14 to receive the refrigerant that is compressed in the compression chamber 14.

The baffle 30 in the preferred embodiment includes a first aperture 56 for guiding the refrigerant between the first fluid cavity 32 and the exit cavity 34 and a second aperture 58 for guiding the refrigerant between the second fluid cavity 52 and the exit cavity 34. In addition, the baffle 30 includes a third aperture 60 for guiding the refrigerant between the third fluid cavity 54 and the second fluid cavity 52 and a fourth aperture 62 for guiding the refrigerant between the third fluid cavity 54 and the first fluid cavity 32. The first, second, third and fourth apertures 56, 58, 60, 62 as illustrated in FIG. 1 can assume a variety of shapes and positions within the baffle 30. As such, the apertures 56, 58, 60, 62 as shown are not intended to limit the subject invention.

The compression chamber 14 includes a first piston 64 and a second piston 66 for compressing the refrigerant. In practice, the compression chamber 14 may include any number of pistons, e.g., seven, for compressing the refrigerant. However, for illustrative purposes, only the first piston 64 and the second piston 66 will be discussed. The first and second piston .64, 66 are schematically shown in FIG. 1 to indicate that the first piston 64 compresses the refrigerant and forces it into the first fluid cavity 32 and then the fluid flows through aperture 56 into the exit cavity 34. The second piston 66 compresses the refrigerant in its compression chamber and then forces it into the exit cavity 34. Both pistons ultimately force the refrigerant fluid through the exit cavity 34 and then through the exhaust port 18) As such, the first fluid cavity 32 and the exit cavity 34 are in operative communication with each other and the compression chamber 14. Moreover, the exit cavity 34 is in operative communication with the exhaust port 18. As a result, the loss in pressure from the compression chamber 14 to the exhaust port 18 is minimized.

Figure 4:
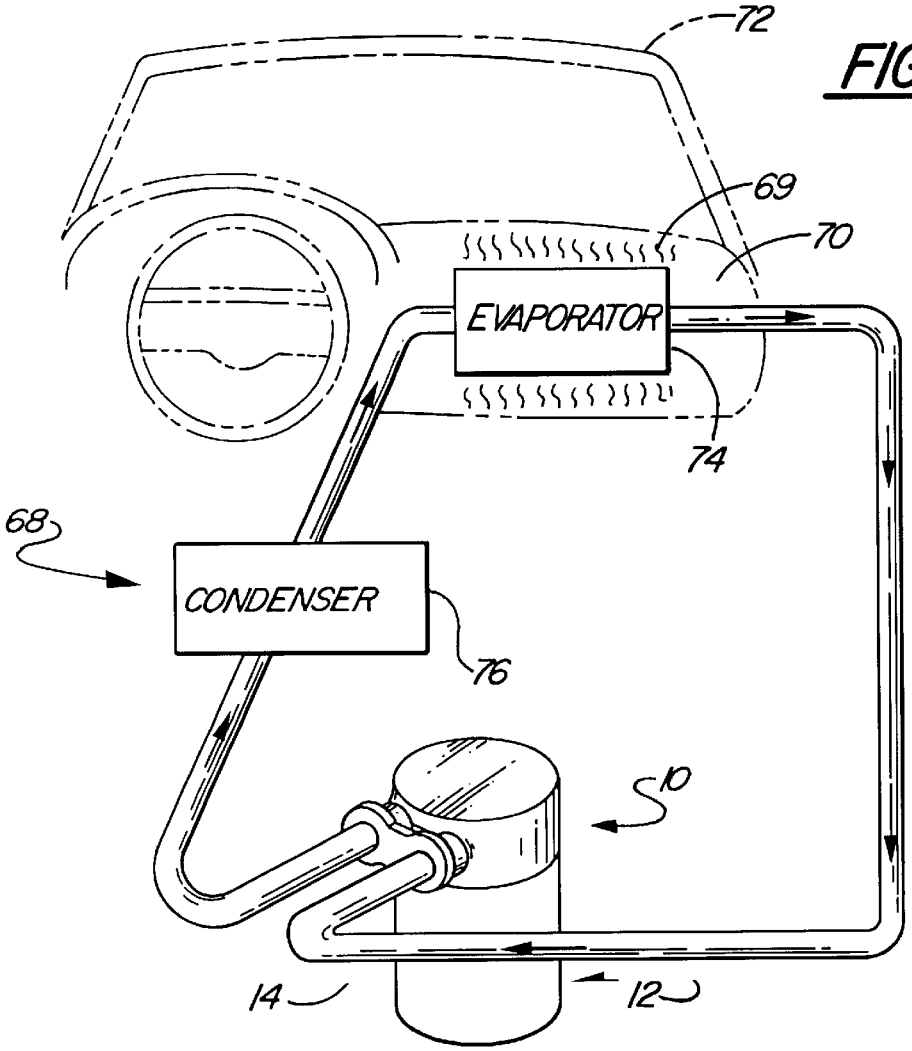
FIG. 4 is a system view of an air-conditioning system including a compressor having a housing, an evaporator and a condenser.

An air-conditioning system 68 for circulating the refrigerant to remove heat 69 from an interior 70 of a vehicle 72 is also disclosed and shown in FIG. 4. For descriptive purposes, the air-conditioning system 68 has been generalized as shown in FIG. 4. The generalized air-conditioning system 68 includes an evaporator 74 for transferring the heat 69 from the interior 70 of the vehicle 72 to the refrigerant and a condenser 76 in fluid communication with the evaporator 74 for cooling and condensing the refrigerant. For descriptive purposes, the heat 69 and the interior 70 of the vehicle 72 are shown schematically in FIG. 4.

The air-conditioning system 68 also includes the compressor 12 as described above. It is to be understood that the air-conditioning system 68 could also include an expander, an accumulator-dehydrator or receiver/dehydrator, an orifice tube or the like. Furthermore, the air-conditioning system 68 is shown schematically in FIG. 4 and lines connecting the compressor 12, an evaporator 74 and a condenser 76 are not intended to represent structure or limit the subject invention. In general, the refrigerant exits the compressor 12 and is guided to the condenser 76 and from the condenser 76 the refrigerant is transferred to the evaporator 74. The refrigerant is then transferred to the compressor 12 to begin the cycle again. The compressor 12 of the air-conditioning system 68 includes the intake port 16, the exhaust port 18, the compression chamber 14 and the housing 20 as described above in the preferred embodiment.

Referring to FIGS. 1 and 2, the housing 20 of the preferred embodiment also includes a plurality of bores 78 for allowing removeable attachment of the housing 20 to the compressor 12 and at least one post 80 for aligning the housing 20 with the compressor 12. The housing 20 further defines a first and second orifice 82, 84 that are used to regulate and monitor the compressor mechanism.

Obviously, many modifications and variations of the present invention are possible in light of the above teachings. The invention may be practiced otherwise than as specifically described within the scope of the appended claims.

What is claimed is:

1. A manifold assembly for use in a compressor having a compression chamber for compressing a fluid, said assembly comprising;

an intake port;

an exhaust port;

a housing coupled to said intake port and said exhaust port and having an outer wall and at least one inner wall, said outer wall and said inner wall defining a suction chamber for guiding the fluid from the intake port to the compression chamber and a discharge chamber for guiding the fluid from the compression chamber to said exhaust port; and, a baffle connected to said housing, said baffle defining a first fluid cavity for receiving the fluid from the compression chamber and an exit cavity for guiding the fluid from said discharge chamber to said exhaust port, wherein said first fluid cavity and said exit cavity are in operative communication with each other and the compression chamber to eliminate acoustic resonance of the fluid in said discharge chamber.

2. The assembly as set forth in claim 1 wherein said baffle includes a first end connected at a first position on said housing and a second end connected at a second position on said housing.

3. The assembly as set forth in claim 2 wherein said baffle includes a third end connected at a third position on said housing and a fourth end connected at a fourth position on said housing, wherein said baffle defines a second fluid cavity for receiving the fluid from the compression chamber and a third fluid cavity for receiving the fluid from the compression chamber.

4. The assembly as set forth in claim 1 wherein said baffle defines a second fluid cavity for receiving the fluid from the compression chamber and a third fluid cavity for receiving the fluid from the compression chamber such that said second fluid cavity is in operative communication with said third fluid cavity, said exit cavity and the compression chamber and said third fluid cavity is in operative communication with said first fluid cavity, said second fluid cavity and the compression chamber.

5. The assembly as set forth in claim 4 wherein said baffle includes a first aperture for guiding the fluid between said first fluid cavity and said exit cavity.

6. The assembly as set forth in claim 5 wherein said baffle includes a second aperture for guiding the fluid between said second fluid cavity and said exit cavity.

7. The assembly as set forth in claim 6 wherein said baffle includes a third aperture for guiding the fluid between said third fluid cavity and said second fluid cavity.

8. The assembly as set forth in claim 7 wherein said baffle includes a fourth aperture for guiding the fluid between said third fluid cavity and said first fluid cavity.

9. The assembly as set forth in claim 2 wherein said first position and said second position are located on said inner wall.

10. The assembly as set forth in claim 3 wherein said third position and said fourth position are located on said inner wall.

11. The assembly as set forth in claim 1 wherein said baffle is made from aluminum and is integrally formed with said housing.

12. The assembly as set forth in claim 1 wherein said exhaust port is connected to said exit cavity and said exit cavity is continuous and unobstructed to guide the fluid from the compression chamber to the exhaust port.

13. The assembly as set forth in claim 1 wherein said intake port is connected to said suction chamber.

14. The assembly as set forth in claim 1 wherein said suction chamber substantially surrounds said discharge chamber.

15. A manifold assembly for use in a compressor having a compression chamber and a first piston and a second piston within the compression chamber for compressing a fluid, said assembly comprising;

an intake port;

an exhaust port;

a housing coupled to said intake port and said exhaust port and having an outer wall and at least one inner wall, said outer wall and said inner wall defining a suction chamber for guiding the fluid from the intake port to the compression chamber and a discharge chamber for guiding the fluid from the compression chamber to said exhaust port; and, a baffle connected to said housing for eliminating acoustic resonance of the fluid in said discharge chamber, said baffle defining a first fluid cavity for receiving the fluid from the compression chamber and an exit cavity for guiding the fluid from said discharge chamber to said exhaust port, wherein the first piston compresses the fluid in said first fluid cavity and the second piston compresses the fluid in said exit cavity.

16. The assembly as set forth in claim 15 wherein said baffle includes a first end connected at a first position on said housing and a second end connected at a second position on said housing.

17. The assembly as set forth in claim 16 wherein said baffle includes a third end connected at a third position on said housing and a fourth end connected at a fourth position on said housing, wherein said baffle defines a second fluid cavity for receiving the fluid from the compression chamber and a third fluid cavity for receiving the fluid from the compression chamber.

18. The assembly as set forth in claim 15 wherein said baffle defines a second fluid cavity for receiving the fluid from the compression chamber and a third fluid cavity for receiving the fluid from the compression chamber such that said second fluid cavity is in operative communication with said third fluid cavity, said exit cavity and the compression chamber and said third fluid cavity is in operative communication with said first fluid cavity, said second fluid cavity and the compression chamber.

19. The assembly as set forth in claim 18 wherein said baffle includes a first aperture for guiding the fluid between said first fluid cavity and said exit cavity.

20. The assembly as set forth in claim 19 wherein said baffle includes a second aperture for guiding the fluid between said second fluid cavity and said exit cavity.

21. The assembly as set forth in claim 20 wherein said baffle includes a third aperture for guiding the fluid between said third fluid cavity and said second fluid cavity.

22. The assembly as set forth in claim 21 wherein said baffle includes a fourth aperture for guiding the fluid between said third fluid cavity and said first fluid cavity.

23. The assembly as set forth in claim 16 wherein said first position and said second position are located on said inner wall.

24. The assembly as set forth in claim 17 wherein said third position and said fourth position are located on said inner wall.

25. The assembly as set forth in claim 15 wherein said baffle is made from aluminum and is integrally formed with said housing.

26. The assembly as set forth in claim 15 wherein said exhaust port is connected to said exit cavity and said exit cavity is continuous and unobstructed to guide the fluid from the compression chamber to the exhaust port.

27. The assembly as set forth in claim 15 wherein said intake port is connected to said suction chamber.

28. The assembly as set forth in claim 15 wherein said suction chamber substantially surrounds said discharge chamber.

29. An air-conditioning system for circulating a refrigerant to remove heat from an interior of a vehicle, said system comprising;

an evaporator for transferring the heat from the interior of the vehicle to the refrigerant;

a condenser in fluid communication with said evaporator for receiving the refrigerant from said evaporator and cooling and condensing the refrigerant;

a compressor having an intake port, an exhaust port, a compression chamber and a housing, wherein said compressor is in fluid communication with said evaporator and said condenser for receiving the refrigerant from said evaporator, compressing the refrigerant in said compression chamber, and pumping the refrigerant to said condenser, said housing being coupled to said intake port and said exhaust port and having an outer wall and at least one inner wall, said outer wall and said inner wall defining a suction chamber for guiding the refrigerant from said intake port to the compression chamber and a discharge chamber for guiding the refrigerant from the compression chamber to said exhaust port; and, a baffle connected to said housing, said baffle defining a first fluid cavity for receiving the refrigerant from the compression chamber and an exit cavity for guiding the refrigerant from said discharge chamber to said exhaust port, wherein said first fluid cavity and said exit cavity are in operative communication with each other and the compression chamber to eliminate acoustic resonance of the refrigerant in said discharge chamber.

30. A manifold assembly for use in a compressor having a compression chamber for compressing a refrigerant, said assembly comprising;

an intake port;

an exhaust port;

a housing coupled to said intake port and said exhaust port and having an outer wall and at least one inner wall, said outer wall and said inner wall defining a suction chamber therebetween for guiding the refrigerant from the intake port to the compression chamber and a discharge chamber therein for guiding the refrigerant from the compression chamber to the exhaust port;

a baffle having a first end connected at a first position on said inner wall, a second end connected at a second position on said inner wall, a third end connected at a third position on said inner wall and a fourth end connected at a fourth position on said inner wall, said baffle defining a first fluid cavity for receiving the refrigerant from the compression chamber, a second fluid cavity for receiving the refrigerant from the compression chamber, a third fluid cavity for receiving the refrigerant from the compression chamber and an exit cavity for guiding the refrigerant from the compression chamber to said exhaust port, wherein said first fluid cavity, said second fluid cavity, said third fluid cavity and said exit cavity are in operative communication with the compression chamber to reduce acoustic resonance of the refrigerant in said discharge chamber.

* * * * *